United States Patent [19]

Braun

[11] Patent Number: 4,513,659

[45] Date of Patent: Apr. 30, 1985

[54] PRESS FOR THE EXPRESSION OF LIQUID FROM LIQUID-CONTAINING SUBSTANCES

[75] Inventor: Oskar Braun, Lindenfels, Fed. Rep. of Germany

[73] Assignee: Josef Willmes GmbH, Bensheim, Fed. Rep. of Germany

[21] Appl. No.: 503,086

[22] Filed: Jun. 10, 1983

[30] Foreign Application Priority Data

Jun. 29, 1982 [DE] Fed. Rep. of Germany ..... 3224086
May 13, 1983 [DE] Fed. Rep. of Germany ..... 3317448

[51] Int. Cl.[3] ..... B30B 9/14

[52] U.S. Cl. ..... 100/117; 100/145; 100/211

[58] Field of Search ..... 100/117, 145, 150, 211, 100/147, 148, 149

[56] References Cited

U.S. PATENT DOCUMENTS 3,434,910 3/1969 Kannegiesser et al. ..... 100/211 X
3,518,936 7/1970 Bredeson ..... 100/117
3,805,961 4/1974 Clark et al. ..... 100/211 X
3,831,516 8/1974 Johnson ..... 100/117 X

FOREIGN PATENT DOCUMENTS 0141465 11/1979 Japan ..... 100/117
4398 1/1982 Japan ..... 100/117

*Primary Examiner*—Peter Feldman
*Attorney, Agent, or Firm*—Kinzer, Plyer, Dorn & McEachran

[57] ABSTRACT

A press for the expression of liquid from liquid-containing substances, comprising a stationary container 2 which has a filling opening 3 and an emptying opening and a rotating screw conveyor 4 made up of a screw shaft 6 with screw-vanes 5, located in the interior of the container. The screw conveyor is covered over by a flexible membrane 13 secured in pressure tight fashion to selected portion of the screw conveyor to rotate therewith. Pressure means flows in the space 15 between the conveyor screw shaft 6, the membrane 13, and the screw vanes 5 so that pressure is exerted on the liquid containing substances located in pressing space 16.

15 Claims, 23 Drawing Figures

PRESS FOR THE EXPRESSION OF LIQUID FROM LIQUID-CONTAINING SUBSTANCES

Figure 1:
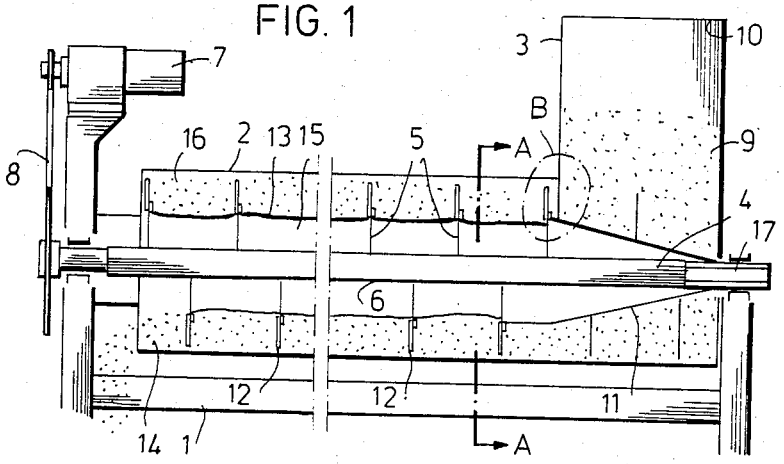

The invention relates to a press for expression of liquids from liquid-containing substances, namely agricultural and chemical products, with a container which has a filling- and an emptying-opening and within the container there is located a pressure membrane consisting of a flexible or elastic material which divides the interior into a pressure means- and press-space.

The most diverse forms of embodiment of membrane presses are already known, amongst which could be named those with tubular membranes, planar-surfaced membranes which are stretched at right angles across the axis of rotation, bag-shaped membranes with their plane of fastening parallel to the axis of rotation, and similar devices. These presses which operate pneumatically or hydraulically have been successful primarily because they are not wasteful of the pressed material in the expression process in which the actual expression procedure is a discontinuous one, that is to say, the press is filled with the material to be pressed and the liquid is completely expressed from it and finally the residue is removed from the press. In order to loosen-up the material being pressed, the container of these known presses must be rotated during the loosening- or breaking-up phase. These presses which operate with discontinuous or batch procedures have the fundamental disadvantage that their efficiency, that is to say, their throughput of pressed material is inadequate, so that very large volume tank presses have been constructed so that the performance could be improved because of the increase in size. However, this requires the use of large amounts of structural material which makes the fabrication of this type of press considerably more expensive.

The problem underlying the invention is the development of a press of the type mentioned initially which would enable the pressing procedure to be carried on continuously while still exploiting the advantages of a membrane press.

This problem is solved according to the invention in that (a) there is a rotating conveyor screw installed inside the stationary container, (b) the conveyor screw is covered over by the pressure membrane in a pressure-tight manner, and that (c) the space existing between the screw vanes and the screw shaft is the space for the pressure means.

Advantageous forms of embodiment of the invention are disclosed in the claims 2 to 15.

The invention provides the fundamental advantage that an efficient pressing of agricultural or chemical products is possible while the structural size of the press can be considerably reduced in comparison with that of the intermittently-operating type of press. A further fundamental advantage is found in the fact that different pressure stages can be established within the press so that the press can be adapted exactly and without difficulty to the particular material for pressing which is being handled at that time. Because of the rapid pressing with the avoidance of the necessity for loosening-up devices there is much less production of turbidity (in the expressed liquid) while there is also a reduction of the danger of oxidation. In addition to this there are only short passages for the liquor through the mash because the layer of material being pressed within the press can be kept quite thin owing to the continuous throughput.

Figure 2:
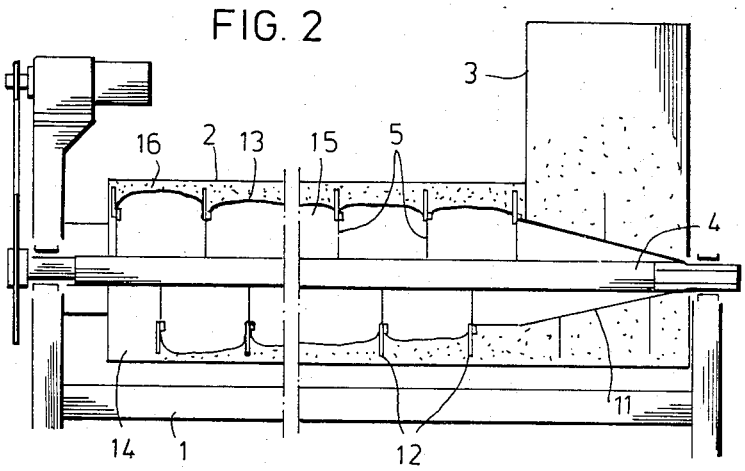
Figure 3:
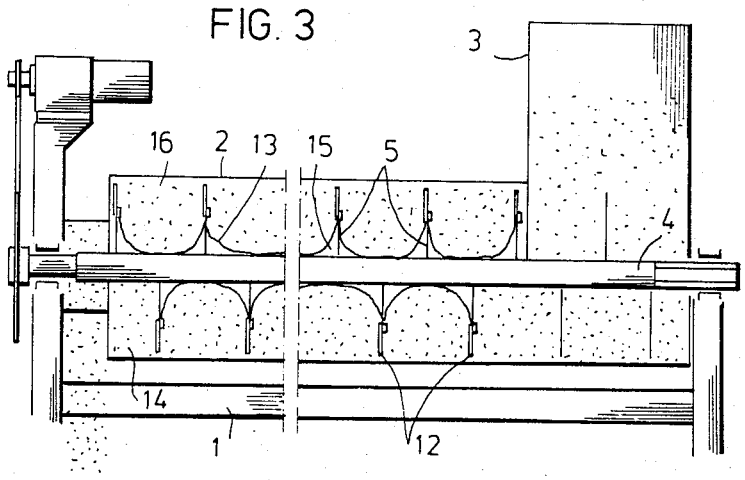
Figure 6:
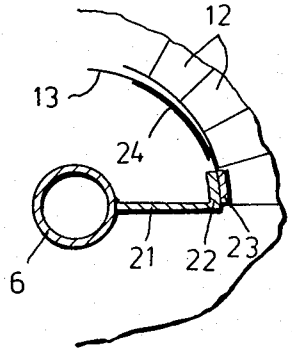
Figure 5:
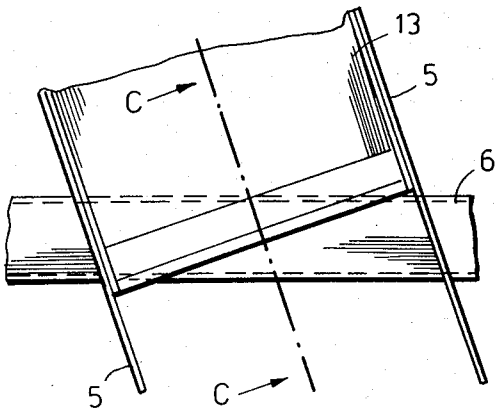
Figure 4:
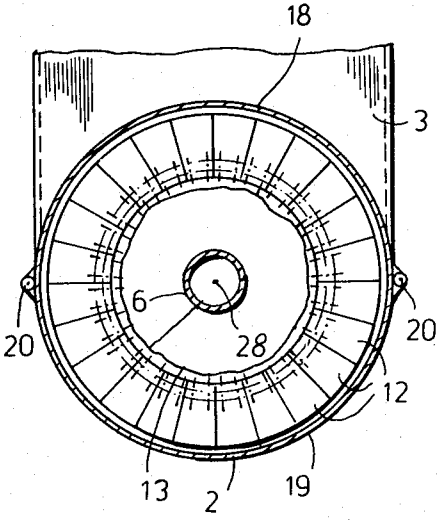
Figure 16:
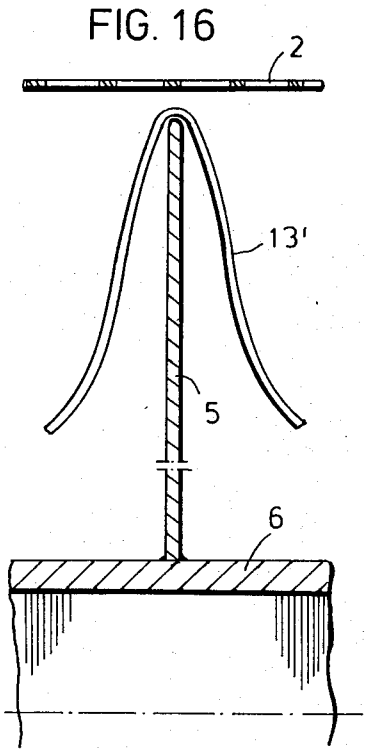
Figure 22:
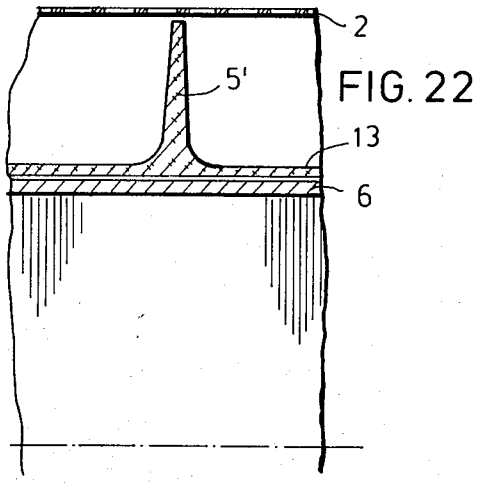
Figure 15:
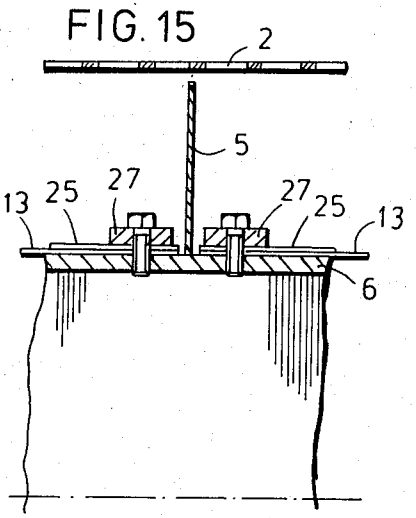
Figure 7:
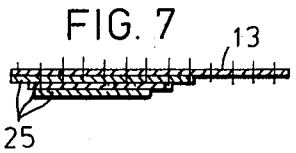
Figure 8:
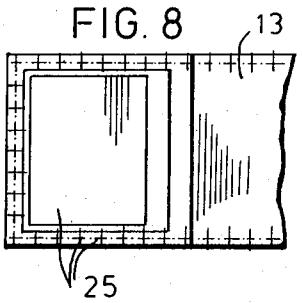
Figure 14:
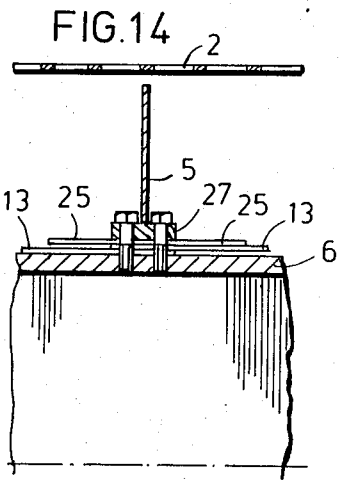
Figure 11:
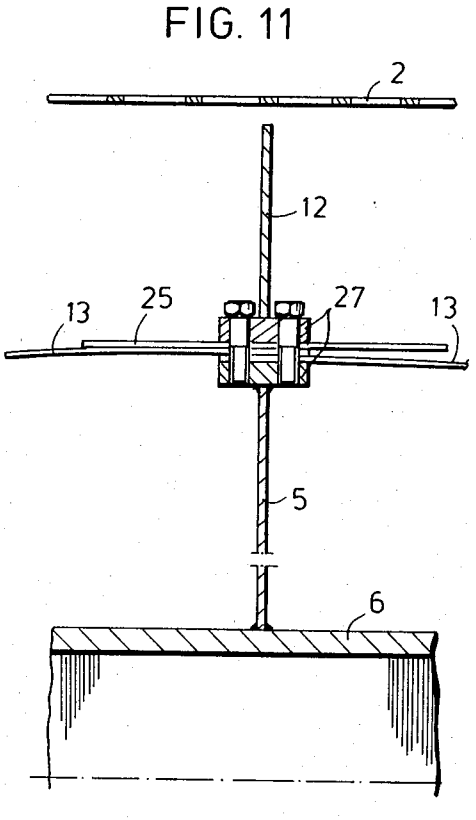
Figure 10:
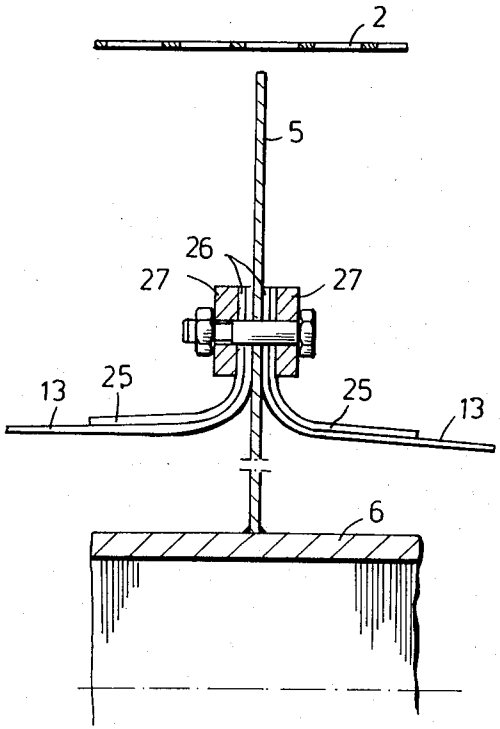
Figure 9:
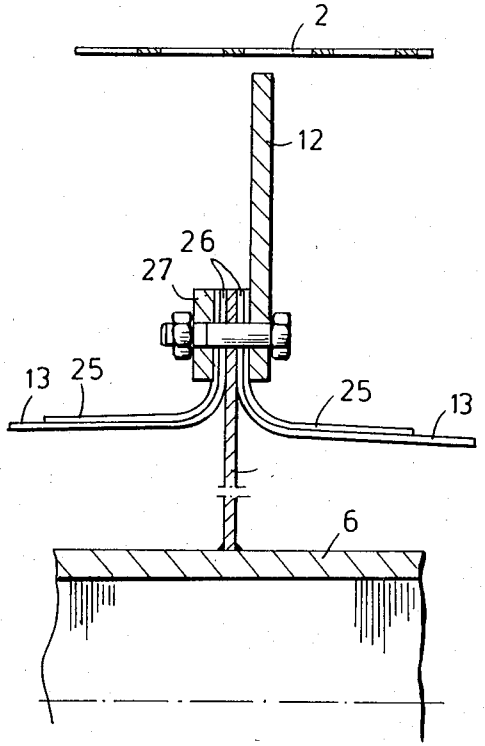
Figure 12:
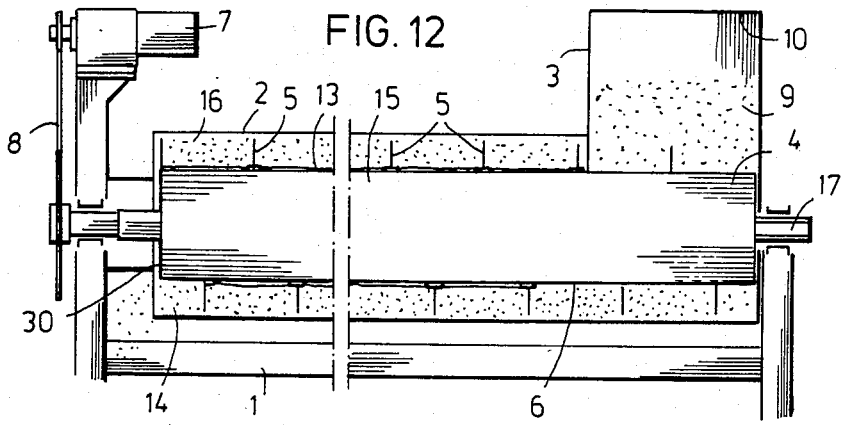
Figure 13:
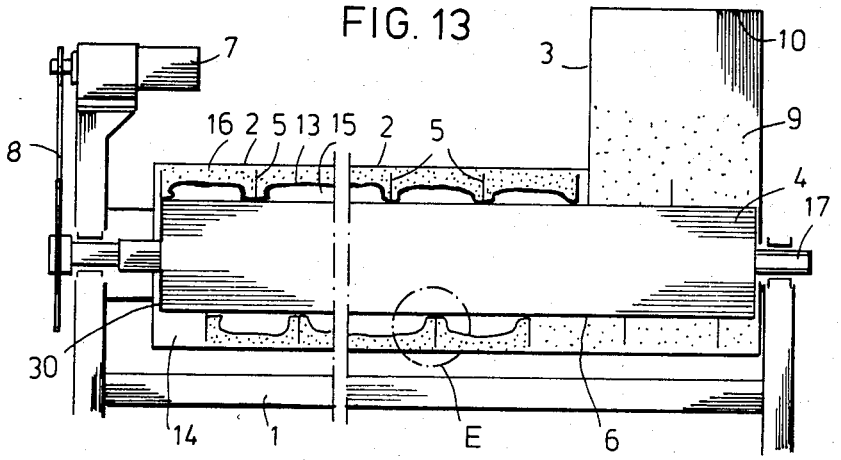
Figure 21:
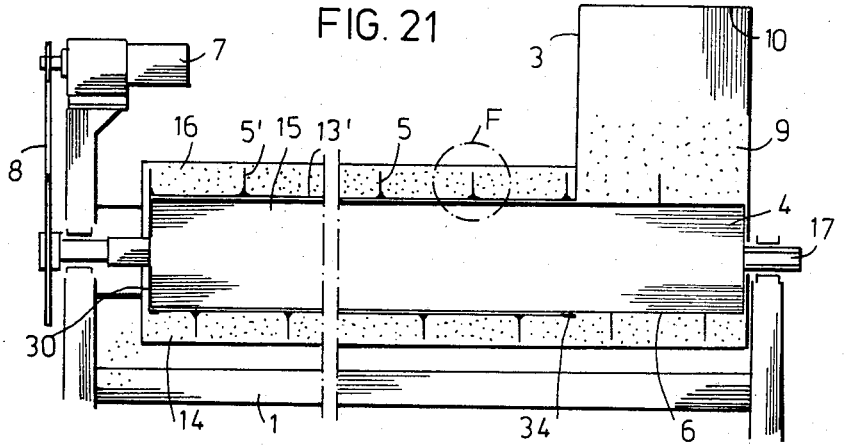
Figure 17:
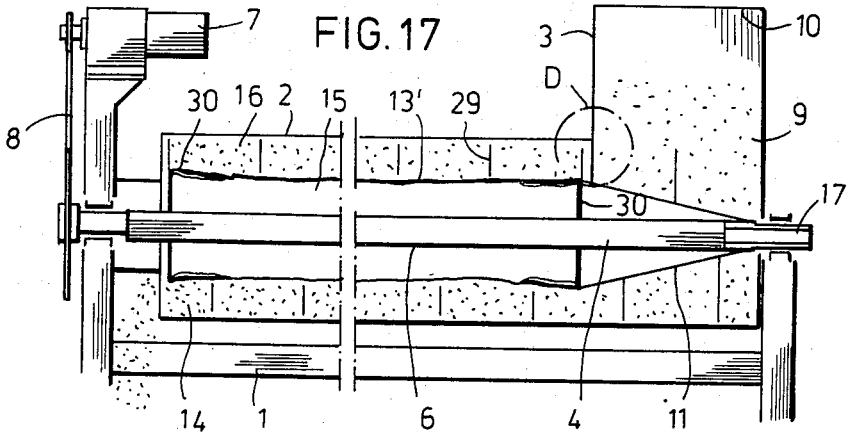
Figure 18:
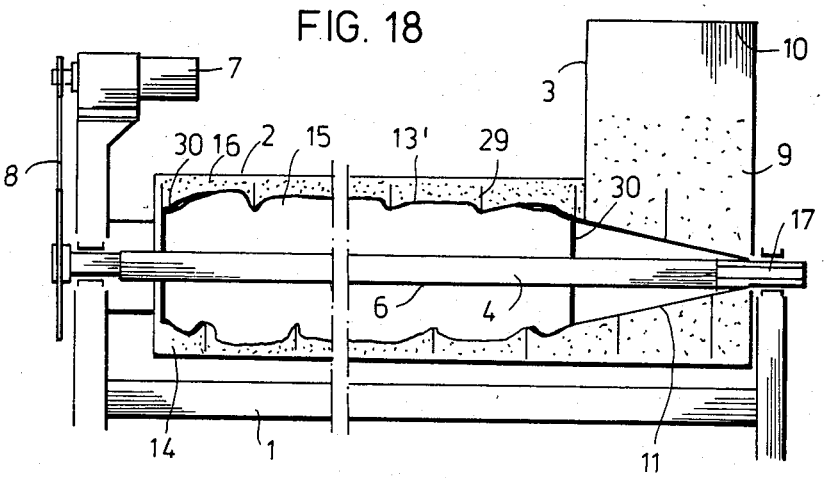
Figure 23:
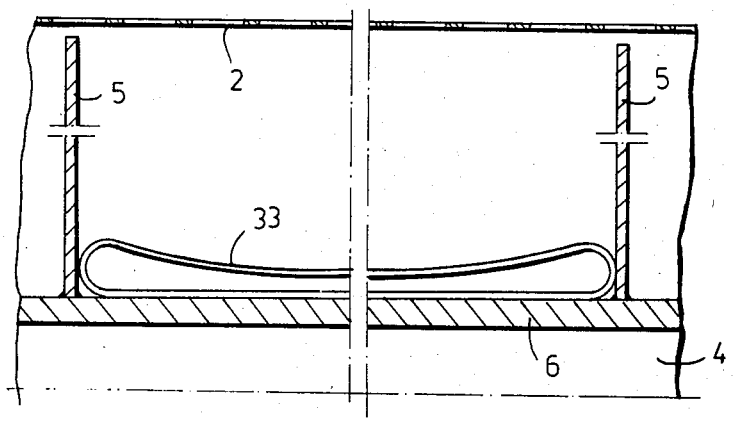
Figure 20:
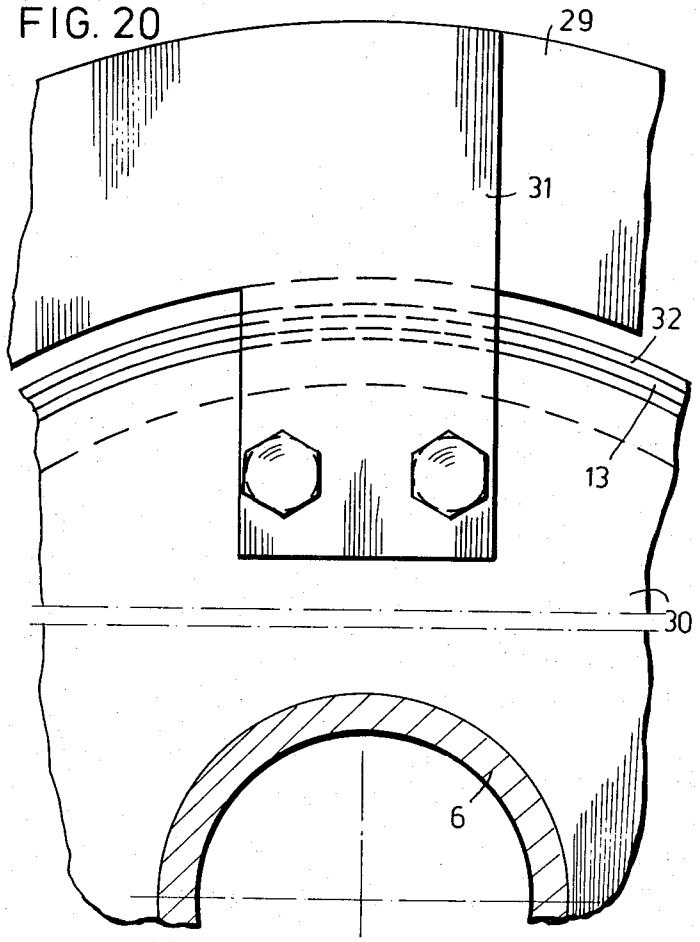
Figure 19:
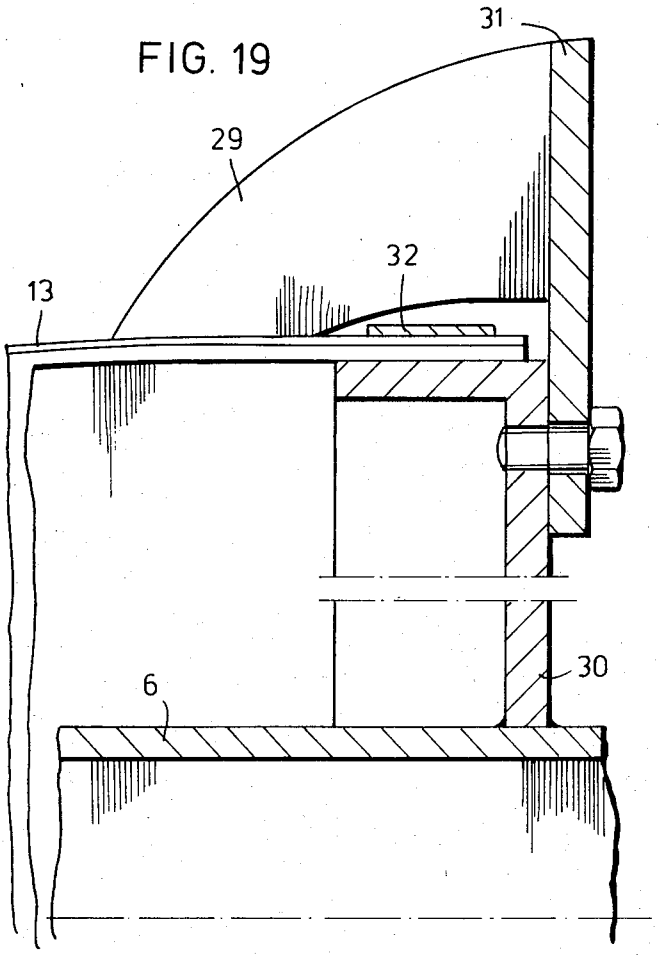

A more detailed explanation of the invention will be given in the following description with reference to the forms of embodiment depicted in the diagrams where there is shown in:

FIG. 1 a longitudinal section of such a press in accordance with a first example of embodiment, FIG. 2 the press depicted in FIG. 1 in the pressing position, FIG. 3 the press in accordance with FIG. 1 during the loosening-up phase and application of vacuum, FIG. 4 a section on the line A—A in FIG. 1, FIG. 5 a view of the detail B in FIG. 1, FIG. 6 a section along the line C—C in FIG. 5, FIGS. 7 and 8 the reinforced end-section of the membrane strip in cross-section and on plan, FIG. 9 a first form of embodiment of the fastening of the membrane-strip on the screw vane, in section, FIG. 10 a further form of embodiment of this fastening, FIG. 11 a third possibility for this fastening, FIG. 12 a further advantageous form of embodiment of this type of press in longitudinal section, FIG. 13 the press shown in FIG. 12 in the operating position, FIG. 14 the detail at E in FIG. 12 for the fastening of the membrane to the screw vane, FIG. 15 a further form of embodiment for this fastening, FIG. 16 a further form of embodiment for the arrangement of a membrane in connection with the conveyor screw with a part view in section, FIG. 17 a further form of embodiment of such a type of press, FIG. 18 the press shown in FIG. 17 in the operating position, FIG. 19 the detail D of FIG. 17 on enlarged scale in elevation and section, FIG. 20 a side elevation of FIG. 19, FIG. 21 another example of embodiment for the configuration of such a type of press in longitudinal section, FIG. 22 the detail F in FIG. 21 on enlarged scale in elevation and section, and FIG. 23 a last form of embodiment of such a type of press in part elevation.

The form of embodiment depicted in FIGS. 1 to 4 of such a press possesses a machine frame 1, upon which a stationary container 2 is mounted and where a filling funnel 3 is located on one side of this container 2. Within the container 2 and the filling funnel 3 there is a conveyor screw 4 mounted on bearings on the machine frame 1 and this conveyor screw is made up of a screw shaft 6 with screw vanes 5 attached to it in a spiral arrangement. The conveyor screw 4 is driven, for example, by the motor 7 through the driving gear 8. In the region of the filling funnel 3, that is to say, of the filling space 9 with the filling opening 10, a conically expanding spiral tube 11 is provided. The individual screw vanes 5 are enlarged at their borders by means of the fastening elements 12, and at these fastening positions there is a pressure-tight membrane 13 stretched across them. In this case the membrane 13 consists of a strip, preferably made from an elastic-rubber material, but it is also possible to use a flexible synthetic- plastic material here, which must then correspondingly sag right down to the screw shaft 6, or else must stretch right out to the border of the container 2, where this strip is wound around spirally between neighboring screw vanes 5 right along to the end of the conveyor screw 4. At the delivery end of the conveyor screw 4 is located the discharge opening 14. The interior of the container 2 is partitioned by the membrane 13 into a space for the pressure means and the pressing space 16 in which the material from which the liquid is to be expressed is placed. In order to introduce the pressure means, the one screw shaft trunnion 17 is provided with an appropriate connection. The screw shaft 6 can also be divided up into several sections so that at least two pressure regions 15 are created in order to operate as different pressure zones.

The functioning of the continuously-operating press is developed as follows: The press is loaded with the material to be pressed via the filling funnel 3, for which purpose this filling funnel is of appropriate size and thus represents a reserve storage device for the continuous operation of the press. Other methods of loading the press are also possible by forwarding the material directly into the pressing space 16, for example by means of a pump or a screw-conveyor.

This filling funnel 3 is located at the start of the screw and the conveyor screw 4 is set in motion and the material from which the liquid is to be expressed is transported for a determined distance, for example, by a half-, one- or one-and-a-half-revolutions, depending upon how often the material to be pressed on the transport- means is to be subjected to pressure and then loosened-up again. During this transport of material the membrane 13 is expediently laid down on the screw shaft, in particular to exclude the possibility of damage. This position is depicted in FIG. 3. As soon as the adjusted part-distance has been travelled, the conveyor screw 4 comes to halt so that the pressure-means can flow in between the conveyor screw 4 and the membrane 13 so that pressure is exerted on the material being processed (FIG. 2). Depending upon the particular type of material being processed, the press remains under pressure for a shorter or longer period of time. After the pressure is released, the conveyor screw 4 once again comes into operation until the next appropriate halt position.

Depending upon the type of material the pressing operation can be completed in one passage, or else one passage through the press can serve as a preliminary one. It is also possible in one passage through the screw conveyor to arrange for several stages of pressure.

FIG. 4 depicts a cross-section through such a type of press, in which case the container 2 is made up from two half-containers 18, 19 which have laterally staggered eyelets 20 which allow for a simple connection of the two halves by passing rods through them. The two half-containers 18, 19 themselves can be constructed in the form of sieves so that the expressed liquid can flow away directly through them. With this type of construction of the container jacket 2 the assembly is very simple and cleaning of the equipment is easily done. In order to reduce the danger of oxidation there can also be a drum-shaped closed jacket mounted in a stationary fashion around the outside of the container 2.

For setting-up, maintenance and cleaning, the two-part construction is the most advantageous, but nonetheless, a single closed unit container can also be utilized which is provided with an access opening, or else the container can be constructed from a larger number of separate segments.

FIGS. 5 and 6 show the start and the finish of the arrangement of the membrane strip 13, in which case there is a web 21 provided on the screw shaft 6 which continues on in a flange 22 bent at an angle so that the membrane 13 can be fastened in a pressure-tight fashion to the flange 22 by means of the pressure strip or beading 23. In this end region 24 of the membrane, this latter is reinforced in such a way that a lateral bulging out into the filling space 9 or into the discharge opening 14 is prevented. FIGS. 7 and 8 depict this end section of the membrane where several layers 25 are placed one on top of the other and fastened together.

FIGS. 9 to 11 depict various possibilities for fastening the border 26 of the pressure membrane 13 where there is a reinforcement 25 also present. In the form of embodiment depicted in FIG. 9, each one of the borders 26 of the membrane is held on the one side against the border of the screw vane 5 by means of a pressure strip 27, and on the other side it is screwed on with the aid of the fastening element 12. In the further form of embodiment in accordance with FIG. 10, the screw vane 5 is appropriately lengthened and the borders 26 of the pressure membrane 13 are fastened within the screw vane 5 with the aid of the pressure beading 27. Finally, in the form of embodiment in accordance with FIG. 11, the pressure beading 27 is applied each time to the front end of the screw vane 5 or else to the fastening elements 12 which enlarge the screw vanes, in which case these two pressure beadings 27 enclosing the border of the pressure membrane are fastened together by means of screws. With this type of arrangement of the membrane (FIGS. 1 to 11), a special protection is provided for the membrane 13 by the protruding border of the spiral in which case the screw is additionally enlarged thereby improving both the transporting and loosening-up effects.

FIGS. 12 to 15 depict a further form of embodiment of such a type of press, where such a form of embodiment is a reasonable one when such a type of press with greater productivity has to be built, which leads to greater length of the equipment. The consequences of this is that the shaft of the conveyor screw 6 must be manufactured with a larger diameter in order to prevent it from flexing or buckling. With an increased diameter for the screw shaft 6, the screw vanes 5 are fastened directly onto the screw shaft 6, for example by having a pressure strip 27 fastened to it to act as a foot and this foot is screwed onto the screw shaft 6, in which case the membrane is clamped into position with the utilization of the reinforcement 25. In the case of the further form of fastening in accordance with FIG. 15, the ends of such a type of strip-shaped membrane 13 are severally fastened to the shaft 6 by means of the pressure strips 27. The screw vanes 5 are solidly welded to the shaft 6.

Instead of such a strip-shaped membrane 13 which is spirally wound along the conveyor screw, it is possible also to use a continuous tubular membrane which is pulled on over the screw and is fastened at each of its ends to the screw in a pressure-tight fashion (FIG. 16). Such a further variant is depicted in FIGS. 17 and 18 where the fastening is effected to the end flanges 30 of the screw shaft 6. As the conveyor screw a so-called spiral ribbon conveyor 29 is used here which is actually fastened at each of its ends to the flanges 30. The membrane 13' then lies internally to this spiral ribbon in which case it can bulge outwards between the separate vanes of this spiral 29 as indicated in FIG. 18. The fastening of this spiral strip is also shown on an enlarged scale in FIGS. 19 and 20, in which case it is seen that the fastening to the flange 30 is effected by means of the end sections 31. Furthermore, the reinforced end of the tubular membrane 13' is affixed in a pressure-tight fashion to each flange 30 by means of the clamping strap 32 at each end.

In the further forms of embodiment depicted in FIGS. 21 and 22, for the fitting-out of such a type of press, a tubular membrane 13' is pulled on over the screw shaft 6 which actually is made with an increased diameter for the screw shaft 6, and this membrane is attached in a pressure-tight fashion to an end flange at the discharge opening 14 and at the filling funnel 3 it is attached with the aid of the clamping ring 34, in which case spiral segments 5' are attached externally to the membrane 13'. These spiral segments 5' can be made from the same type of material as the membrane 13', and by way of example, they may be vulcanized on, attached with adhesive, or else they can be fastened to the membrane by temporary, removable, means. It is also possible, by way of example, to fabricate the membrane 13' integrally with the spiral segments 5', by way of a casting or moulding process.

Finally, in FIG. 23, a form of embodiment of such a press is outlined, in which a tube 33 is arranged between the screw vanes 5 of the spiral, in which case this tube 33 extends over the whole length of the conveyor screw 4 or the container 2 jacket as the case may be. With the help of a pressure-supply means, the tube can be inflated in such a manner that it bulges outwards against the walls of the container 2 thus giving rise to the pressing effect.

I claim:

1. Press for expression of liquid from liquid-containing substances, namely agricultural and chemical products, with a container which has a filling- and an emptying-opening and within the container there is located a pressure membrane consisting of a flexible or elastic material which divides the interior into a pressure means- and press-space, characterized in that (a) in the interior of the stationary container (2) a screw-conveyor (4) is located, and (b) the screw-conveyor (4) is covered over by the pressure membrane (13, 13') secured in a pressure-tight fashion to selected portions of the screw conveyor to rotate therewith, and (c) the space (15) between the screw vanes (5) and the screw shaft (6) is the space for the pressure means.

2. Press in accordance with claim 1, characterized in that a filling space (9) is provided at the beginning (11) of the screw.

3. Press in accordance with claim 2, characterized in that provision is made of a strip-shaped pressure membrane (13) which is shaped spirally to correspond with the course of the screw vanes (5) and this is fastened in a pressure-tight fashion to the neighboring screw vanes (5).

4. Press in accordance with claim 3, characterized in that reinforcing elements (12) are arranged alongside one another on the borders of the screw vanes (5) to increase the size of the screw vanes (5).

5. Press in accordance with claim 4, characterized in that with the enlarged diameter of the screw shaft (6) the membrane (13) is fastened to the screw shaft (6) in the region of the screw vanes (5).

6. Press in accordance with claim 5, characterized in that the border (26) of the pressure membrane (13) is fastened in a pressure-tight fashion onto the screw vanes (5), for example with the aid of pressure strips (23, 27).

7. Press in accordance with one of the claim 6, characterized in that the fastening border (24, 26) of the pressure membrane (13, 13') is provided with reinforcement (25).

8. Press in accordance with claim 1, characterized in that a continuous tube-shaped pressure membrane (13') is pulled on over the screw vanes (5) and it is fastened both at the beginning and the end of the pressure space to the screw-conveyor (4) in a pressure-tight fashion.

9. Press in accordance with claim 1, characterized in that the pressure membrane (13') covers the screw shaft (6) in a pressure-tight fashion, and that spiral segments (5') are attached to the membrane (13') which is configured as a tube, and that the space (15) located between the spiral segments (5') and the screw shaft (6) is the space for the pressure means.

10. Press in accordance with one of the claim 7, characterized in that a spiral member (29) is fastened to the end flanges (30) of the screw shaft (6) and the tube-shaped membrane (13') is located between the spiral (29) and the shaft (6).

11. Press in accordance with claim 1, characterized in that a rotating screw conveyor (4) is provided on a screw shaft (6) in the interior of the stationary container (2), and that between adjacent screw vanes (5, 12) of the conveyor screw (4) there is a tube (33) arranged in the form of a membrane, and that the interior (15) of the tube (33) is the space for the pressure means.

12. Press in accordance with one of the claim 11, characterized in that the spiral tube (11) in the region of the filling space (9) has a conical configuration and is provided with a pressure-means connection (17).

13. Press in accordance with one of the claim 12, characterized in that the container (2) is fabricated in the form of a sieve.

14. Press in accordance with claim 13, characterized in that the container (2) is divided into two half shells (18, 19) by a plane passing along the axis of rotation (28) of the conveyor screw.

15. Press in accordance with claim 14, characterized in that there is a second closed jacket surrounding the container (2).

* * * * *